US006206667B1

(12) United States Patent
Turner, Jr. et al.

(10) Patent No.: US 6,206,667 B1
(45) Date of Patent: Mar. 27, 2001

(54) PUMP FOR DISPENSING RESINS

(75) Inventors: Herman E. Turner, Jr., Wellington; Mario Romanin, Grafton, both of OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/173,011

(22) Filed: Oct. 15, 1998

(51) Int. Cl.[7] ..... F03C 2/00

(52) U.S. Cl. ..... 418/178; 418/179; 418/206.9; 417/218; 73/205 R

(58) Field of Search ..... 418/178, 179, 418/206.9; 417/218; 73/205 R

(56) References Cited

U.S. PATENT DOCUMENTS

| | | | | |
|---|---|---|---|---|
| 3,583,220 | * | 6/1971 | Kawakami | 73/205 R |
| 4,540,343 | * | 9/1985 | Perkins | 417/218 |
| 4,682,939 | * | 7/1987 | Petro | 418/178 |
| 5,364,248 | * | 11/1994 | Nakashima et al. | 418/178 |
| 5,993,183 | * | 11/1999 | Laskaris et al. | 418/178 |

FOREIGN PATENT DOCUMENTS

| | | | | |
|---|---|---|---|---|
| 19606312A1 | * | 8/1997 | (DE) . | |
| 62-021755 | * | 1/1987 | (JP) | 418/179 |

OTHER PUBLICATIONS

Balzers Tool Coating Inc., *Infotech: Update*, Leaflet, undated.
Balzers Tool Coating Inc., *Balinit® Futura*, Leaflet.
Balzers Tool Coating Inc., *Balinit® X.treme*, Leaflet.
Balzers Tool Coating Inc., *Titanium Carbonitride Coating Fact Sheet*, Leaflet, undated.
Balzers Tool Coating Inc., *Chromium Coatings Fact Sheet*, Leaflet, 9/93.
Balzers Tool Coating Inc., *Balinit® Coatings for Improved Productivity*, Brochure, undated.

* cited by examiner

*Primary Examiner*—Thomas Denion
*Assistant Examiner*—Thai-Ba Trieu
(74) *Attorney, Agent, or Firm*—Wood, Herron & Evans, L.L.P.

(57) ABSTRACT

A gear pump for metering resins is provided having the surfaces of interacting internal metal parts coated with a metal-based material to prevent seizing of the interacting moving parts as a result of resin curing therebetween. Parts made from such materials as heat treated carbon steel and stainless steel are preferably coated with a nitride, carbide or oxide of such metals as tungsten, titanium, aluminum and chromium at a thickness of between about 2–5 microns. The coating is applied to the surface of any part that comes in heated contact with the surface of another relatively moving part. The resulting gear pump exhibits high wear resistance, longevity, and low maintenance requirements.

12 Claims, 2 Drawing Sheets

PUMP FOR DISPENSING RESINS

FIELD OF THE INVENTION

This invention generally relates to pumps and, more specifically, to gear pumps designed to meter epoxy resins.

BACKGROUND OF THE INVENTION

Metering gear pumps operate by squeezing out accurate volumes of liquid between meshing gears. Typically, the gears are mounted within stacked plates that are appropriately ported to receive liquid between the gears and discharge the liquid in one or more streams.

In highly accurate gear pumps useful for metering resins, for example, tolerances are critically maintained between pump bearings and shafts as well as between support plates (often referred to as "kidney plates") and gears. Theoretically, these part relationships maintain so-called "zero clearance." Due to the close tolerances maintained on the various internal components of the gear pump, frictional heat build-up can become a significant problem. At times, this can cause relatively moving parts to adhere to one another when dispensing materials such as certain epoxy resins. This problem is believed to be most prevalent in areas of the pump where there is little or no clearance between relatively moving parts and little or no flow of liquid, such as resin, to act as a lubricant or coolant. In this latter regard, undesirable temperature increases between the gears and the support plates can be prevented by resin flowing through such areas to essentially act as a lubricant or coolant. However, frictional temperature increases between a bearing surface and associated shaft, for example, may be much higher due to the combination of close dimensional tolerances and a low flow or amount of resin between these components. Particularly when both the bearing and associated shaft are formed of metal, this heat build-up can cause the associated bearings and shafts to adhere to one another and decrease pump performance. The resulting pump downtime and maintenance or replacement of the pump considerably increases costs to the user.

In one type of metering gear pump, the above-mentioned problem has been experienced between an idler gear and its associated shaft when these components move relative to each other, and also between the various shafts and their associated bearings or bushings, which also move relative to each other. While non-metallic parts, such as ceramic bushings, have been used to reduce the problem, the use of such parts throughout the pump may not be practical. This experience prompted the need to evaluate the effect of resins on the internal moving parts of a pump and, specifically, evaluate situations in which the internal parts move relative to each other with very close tolerances. Solving the problems related to heat build-up and particularly part adherence in such pumps will result in pumps requiring lower maintenance and having longer useful lives.

SUMMARY OF THE INVENTION

The present invention provides a gear pump for dispensing resin wherein the pump includes internal metal parts with a coating of a nitride, carbide or oxide of a metal. Generally, the coating is applied to at least one surface of an internal metal part that interacts with another metallic or non-metallic part in a relatively moving fashion. In other words, at least one part is moving against or in very close relation to the other to create undesirable frictional heat. The coating has been found to prevent adherence of the parts to one another as a result of resin curing between the parts. The internal coated parts are preferably made from such metals as stainless steel or other metals that are heat treatable to a Rockwell C hardness of about 56 or higher and generally of high strength and wear resistance. The preferred coating also has a Rockwell C hardness of at least about 56. Other non-coated parts may be made from various ceramic, polymeric or metallic materials.

The coating material of this invention is most preferably a metal-based material such as nitride, carbide or oxide of a metal such as tungsten, titanium, aluminum or chromium. The coating is most preferably applied in at least one layer to the interacting, relatively moving internal metal surfaces of a pump. The coating thickness has been advantageously applied in a range of about 2 to 5 microns. The coated surfaces may be associated with shafts or bushings, but any desired internal parts may be coated in accordance with the invention to help prevent the consequences of frictional heat build-up especially when dispensing resins employing a flame retardant additive. The coatings of the present invention improve gear pumps for metering resins in several ways. These pumps will have high wear resistance, longer useful lives and less maintenance when, for example, pumping various epoxy resins such as those employing a flame retardant additive.

These and other objects and advantages of the present invention shall become more apparent from the accompanying drawing and the following detailed description.

BRIEF DESCRIPTION OF THE DRAWING

The accompanying drawing, which is incorporated in and constitutes a part of this specification, illustrates various embodiments of the invention applied to one representative pump and, together with a general description of the invention given above, and the detailed description given below, serves to explain the principles of the invention.

DETAILED DESCRIPTION OF THE PREFERRED EMBODIMENTS

Figure 1:
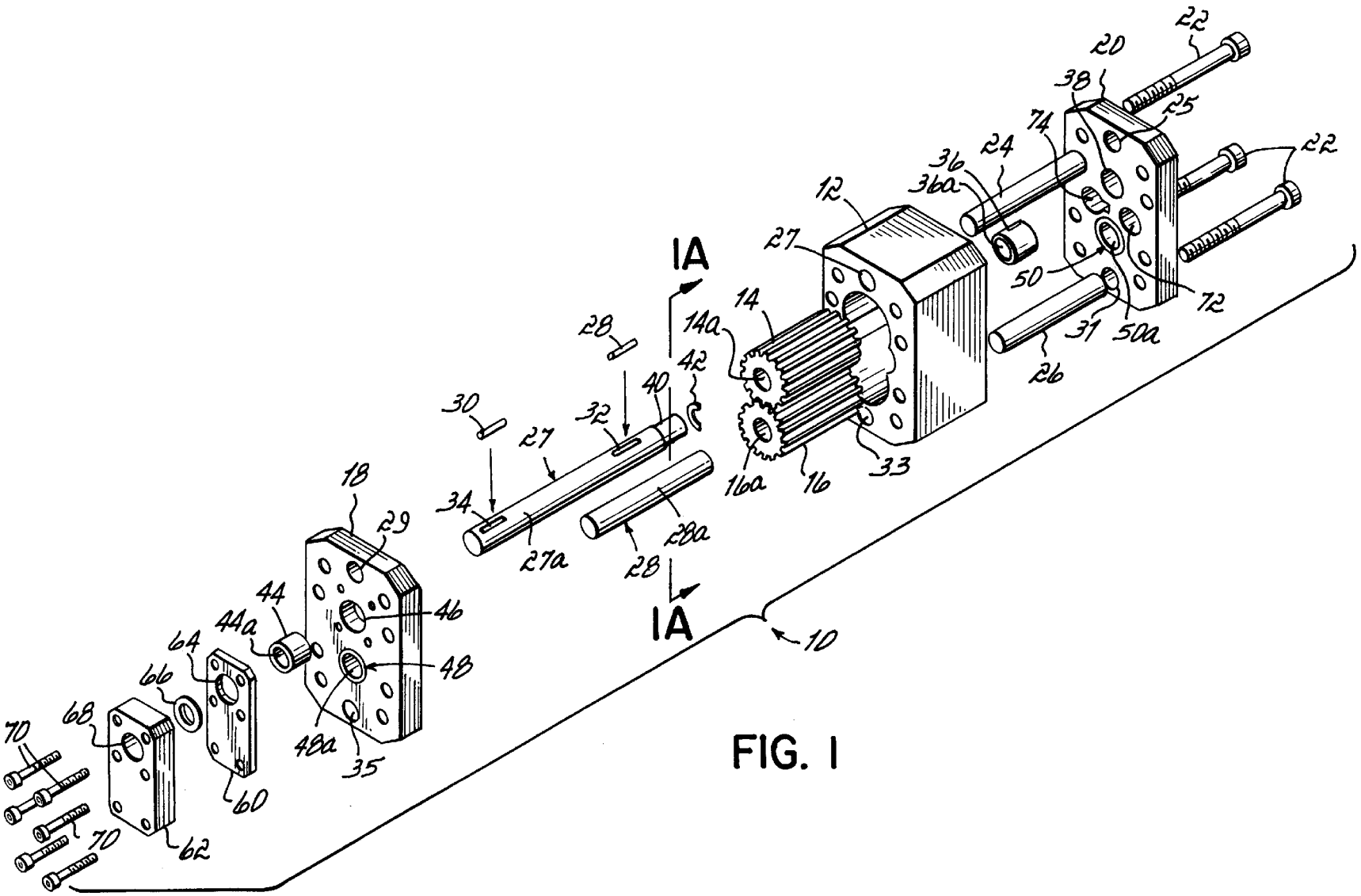
FIG. 1 is an exploded perspective of a typical gear pump for metering resins.

A series of tests were performed using an epoxy resin sandwiched between two metal and/or ceramic pieces, such as blocks, cylinders, bushings, support plates, etc., each having at least one flat surface. A flat surface of one piece was covered with the epoxy resin and placed with the flat surface facing up on a tray. The flat surface of the second piece was placed on top of the first piece, placing pressure on the epoxy resin to create a thin layer of resin between the two flat surfaces. The metal pieces were made from various materials, such as heat treated hardened steel, stainless steel, aluminum, brass, ceramic material, TEFLON®, PEEK® and TORLON®. The tray containing one or more sets of these non-moving opposing pieces was placed in an oven and the pieces were heated to a specified temperature for a specified length of time. The tray was then removed from the oven and a determination made as to whether adhesion occurred between the two flat surfaces of the pieces.

The first six tests were performed as generally described above using various combinations of metal and ceramic pieces together with a standard solventless epoxy resin (available commercially from Shell Chemical Company, Houston, Tex.), for use in printed circuit board production and fabrication. This epoxy resin contains an additional material for the purpose of imparting flame-retardant properties to the epoxy resin. In this case, T-Brome (tetrabromo bisphenol A) was used as the flame-retardant additive. The seventh test was run with a resin which did not have the T-Brome additive. The specifics of each test and the results were as follows:

Test 1

Pieces made from various materials (steel, stainless steel, aluminum, brass, various ceramics), with like materials in contact, were held at a temperature of 220° F. (105° C.) for more than 72 hours with no adhesion occurring between opposing pieces of like or different material.

Test 2

Pieces made from stainless steel and brass (copper or nickel-based parts) adhered to opposing pieces made of like material when the temperature was elevated to 260° F. (127° C.) and held at that temperature for more than 72 hours. The pieces could not be broken free.

Test 3

Pieces made from stainless steel, brass, aluminum, steel, and other similar materials adhered to opposing pieces made of like material when the temperature was elevated to 440° F. (227° C.) and maintained for 3 hours. The pieces could not be broken free.

Test 4

Parts made from TEFLON®, PEEK® or TORLON® did not adhere to opposing pieces made of like material when the temperature was elevated to 440° F. (227° C.) and maintained for 3 hours. The pieces slid on each other freely.

Test 5

Pieces made from TEFLON®, PEEK® or TORLON® exhibited some adhesion to opposing pieces made of stainless steel when the temperature was elevated to 440° F. (227° C.) and held at that temperature for 3 hours. The pieces could be broken free with moderate effort.

Test 6

Pieces formed of 440C stainless steel and M2 tool steel were coated with titanium nitride in accordance with the present invention. These pieces did not adhere to opposing pieces made of like material and also having the titanium nitride coating when the temperature was elevated to 440° F. (227° C.) and maintained for 3 hours. Instead, the pieces slid on each other freely.

Test 7

An additional test was performed as described above, but instead using a special epoxy resin blend (10 parts EPON® Resin 828 (difunctional bisphenol A/epichlorohydrin derived liquid epoxy resin) and 1 part EPON® Resin 1031 (solid multifunctional epichlorohydrin/tetraphenylol ethane epoxy resin), both available from Shell Chemical Company, Houston, Tex.). This blend did not contain the additional material (T-Brome) for imparting flame-retardant properties. Pieces made from stainless steel, brass, aluminum, heat treated steel, and other similar materials did not adhere to opposing pieces made of like material when the temperature was elevated to 440° F. (227° C.) and held at that temperature for 3 hours. The pieces slid on each other freely.

The above testing demonstrated that metal pump components may contain an element acting as a curing agent with additional materials, such as the flame retardant additive, in the epoxy resin blend and, together with elevated temperatures, may cause thin films of the resin to cure. In practice, the gear pump typically runs with the epoxy resin at a temperature around 220° F., as used in Test 1. When the actual parts are moving relative to each other, however, the heat generated by the surfaces rubbing together is believed to cause the temperature to rise above the running temperature of the pump. Thus, although the parts were not moving during testing, the elevated test temperature was applied to simulate the actual condition believed to be created by the heat of friction. Coating the internal metal parts of the gear pump with an appropriate coating material according to the invention will prevent curing of the epoxy resin blend if the coating lacks the ability to act as a curing agent. Thus, the coatings of the present invention prevent thin films of the epoxy resin from curing between relatively moving pump components.

FIG. 1 illustrates a metering gear pump 10 in exploded fashion. Gear pump 10 may be used for dispensing resin, such as of the type described above, in accordance with the invention. For example, pump 10 may be a single stream pump obtained from the Zenith Pumps Division, Parker Hannifin Corporation, Sanford, N.C. Gear pump 10 generally includes a central gear support plate or body 12 for holding a pair of meshing gears, specifically, a drive gear 14 and an idler gear 16. A pair of side support plates 18, 20 are fixed on opposite sides of gear support plate 12 by a plurality of fasteners 22, only three out of four being shown in the drawing for clarity. To aid in aligning all of the various components of pump 10, a pair of dowels 24, 26 are respectively inserted through holes 25, 27, 29 and 31, 33, 35 of support plates 20, 12, 18, respectively. Pump 10 further includes a drive shaft 27 and an idler shaft 28 respectively mounted within axially extending holes 14*a*, 16*a* of gears 14, 16. Drive shaft 27 preferably includes a pair of keys 28, 30 retained within respective keyways or slots 32, 34. Key 28 also registers within a keyway (not shown) disposed in axial bore 14*a* of drive gear 14 to retain the same for rotation with drive shaft 27. Key 30 is used to connect drive shaft 27 with an appropriate drive (not shown) for operating pump 10. Idler shaft 28 is preferably bonded within axial bore 16*a* of idler gear 16 using a commercially available adhesive, such as LocTite®. A bushing 36 is retained within a bore 38 in side support plate 20 and receives a reduced diameter end 40 of drive shaft 27. A retaining clip 42 prevents further movement of drive shaft 27 into bushing 36. Another bushing 44 is retained within a bore 46 of side support plate 18 and receives drive shaft 27 therethrough for free rotation. A similar of pair of bushings 48, 50 are likewise retained within side support plates 18, 20 and receive the end of idler shaft 28 for rotation therein. Respective seal plates 60, 62 are used to seal bushings 44, 48. Drive shaft 27 extends through an opening 64 in seal plate 60, as well through a lip seal 66 and another hole 68 in seal plate 62 such that key and keyway 30, 34 may be exposed for connection with a drive (not shown). The entire seal assembly is held to side support plate 18 by a plurality of threaded fasteners 70. The other side support plate 20 includes a liquid resin inlet 72 and a liquid resin outlet 74. Inlet 72 communicates with a space between and on one side of gears 14, 16, while outlet 74 communicates with a similar space between gears 14, 16, but disposed on an opposite side thereof. In this manner, rotation of drive gear 14 by drive shaft 27 will rotate idler gear 16 and move or meter resin from inlet 72 to outlet 74 by forcing it between the intermeshing gears 14, 16.

Figure 1A:
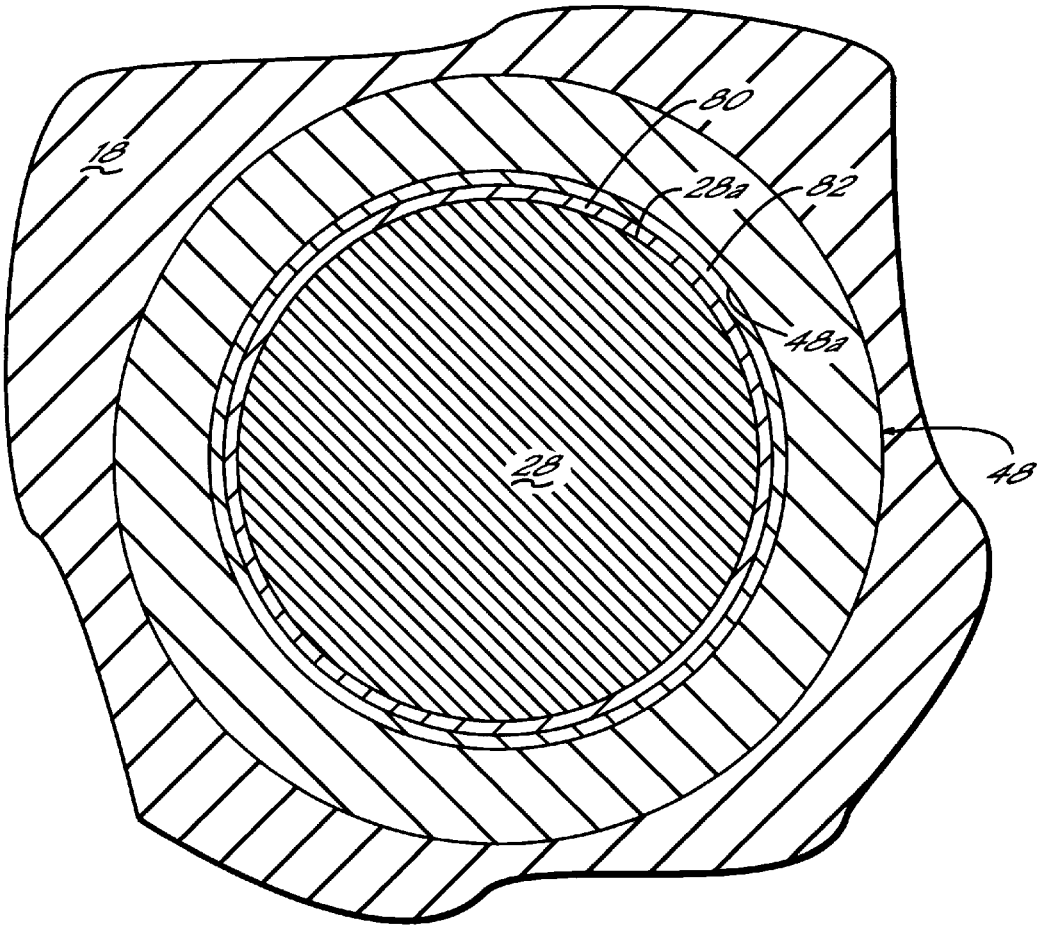
FIG. 1A is a partial cross-sectional view generally taken along line 1A—1A of the pump shown in FIG. 1 depicting a shaft and bearing assembled together and coated in accordance with the present invention.

In the preferred embodiment of this invention, all running surfaces, or interacting surfaces, of metal pump components having a Rockwell C hardness greater than 56 are coated in accordance with this invention to prevent adherence between the pump components. For example, such adherence can often take place between respective internal surfaces 36*a*, 44*a* of bushings 36, 44 and surfaces 48*a*, 50*a* of bushings 48, 50 and external surfaces 27*a* and 28*a* of the corresponding shafts 27, 28. Especially when each of these parts is formed of metal, such as stainless steel or other steel hardened to a Rockwell C hardness above 56, it is important that the coating of the present invention be applied to at least the external surfaces 27*a*, 28*a* of shafts 27, 28 or the internal surfaces 36*a*, 44*a*, 48*a*, 50*a* of bushings 36, 44, 48 and 50. More preferably, each of these external and internal surfaces are coated in accordance with the invention. FIG. 1A depicts in cross-section shaft 28 inside bearing or bushing 48. As shown, the external surface 28A of shaft 28 has a coating 80 in accordance with the invention. Internal surface 48A of bushing 48 has a coating 82 in accordance with the invention. It will be appreciated that certain components may be formed of nonmetallic materials which do not need to be coated in accordance with the invention, and which may allow an associated interacting metal component to remain uncoated. For example, various bushings in the pump could be formed of ceramic material and, in such cases, the associated shaft retained in the bushing may also not need to be coated. In the embodiment shown, idler shaft 28 is retained in a fixed manner within idler gear 16. Therefore, for this particular case, no coating in accordance with the invention is necessary between shaft 28 and idler gear 16. To be comprehensive, all metallic internal parts in the pump may be coated in accordance with the invention to provide the greatest assurance that undesirable adherence between pump components will not occur.

The coating material is advantageously a nitride, carbide or oxide of a metal and is applied in a preferred thickness of about 2–5 microns. When taken to an advanced state, these materials become inert to the chemistry of the epoxy. It is desirable that the coating have the ability to inhibit the chemical reaction occurring between the metal pump components and the epoxy resin blend. In addition, a coating of the present invention should be wear resistant and offer a low coefficient of friction. The coating must allow the surfaces of the parts to act as bearing surfaces. Nitrides, carbides and oxides of tungsten, aluminum, titanium and chromium, for example, can offer the above described properties. The coating is advantageously applied by physical vapor deposition at a thickness in a range of about 2 microns to about 5 microns. Other coating methods and thickness, however, may be suitable.

The base metal of the coated part is also a factor in determining what coating may be used. The base metal should offer good adhesion with the coating and enough hardness to support the coating without the occurrence of plastic deformation in the base metal. For some applications, conventional heat treated carbon steel is the preferred base metal for gear pump parts, given its high hardness and strength, resistance to wear and resistance to softening at high temperatures. Stainless steel, though softer at high temperatures, may also be used in the invention. Other softer metals, such as aluminum and brass, while not preferred for the pumps discussed specifically herein, might be used in certain applications.

To determine if a coating that offers good durability and a low coefficient of friction and adheres to the base metal will inhibit the undesired chemical reaction, the coating material is tested with the epoxy resin blend to be used in the particular application. If the parts adhere, a different coating may be used in accordance with the invention. Taking into consideration the above factors, one skilled in the art may determine an appropriate coating for a given application. For example, coating hardened carbon steel or stainless steel with WC/C (tungsten carbide/carbon) will inhibit the chemical reaction taking place between the epoxy resin blend having a flame retardant additive as mentioned herein and the steel while enhancing adhesive wear resistance and reducing the coefficient of friction between the mating components. Alternatively, coating hardened carbon steel or stainless steel with TIAIN (titanium aluminum nitride) will inhibit the chemical reaction taking place between the same epoxy resin blend and the steel while enhancing abrasive wear resistance in extreme service applications. Among other potential coatings to be used in accordance with the principles of the present invention are titanium carbonitride, chromium nitride, chromium carbide, and chromium oxide. Coatings may also be applied in layers. For example, the gear pump may have a shaft with a first coating of titanium aluminum nitride and a second coating of tungsten carbide carbon in contact with a bearing having a titanium aluminum nitride coating.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, various additions may be made to the resin to enhance or develop certain properties of the resin. Various additives to resins may react with an element present in the base metal of the part. The presence of an appropriate coating, determined according to the principles of the present invention, has the potential for preventing various adverse reactions. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A pump for dispensing resin, the pump comprised of a plurality of internal, relatively moving parts with at least two of the internal parts being metallic and having interacting surfaces wherein one of the two metallic internal moving parts is coated with an underlayer of titanium aluminum nitride and an outer layer of tungsten carbide carbon and the other of the two metallic internal parts is coated with titanium aluminum nitride.

2. The pump of claim 1, wherein the coating on each of the two metallic internal parts has a thickness between 2 microns and about 5 microns.

3. The pump of claim 1, wherein the two metallic internal parts have a Rockwell C hardness of at least about 56.

4. The pump of claim 1, wherein the internal moving parts are made from a material selected from the group consisting of: carbon steel, stainless steel and heat treated steel.

5. The pump of claim 1, wherein the internal moving parts are made from a material selected from the group consisting of: tool steel, stainless steel, aluminum, and brass.

6. The pump of claim 1 further including meshing gears for dispensing the resin in metered amounts.

7. A gear pump for dispensing resin, the pump comprised of metallic internal, relatively moving parts including a shaft and a bushing, said shaft and said bushing having respective metallic interacting surfaces, wherein each of said metallic interacting surfaces is coated with at least one coating material selected from the group consisting of: a metal-based nitride, a metal-based carbide, and a metal-based oxide.

8. The gear pump of claim 7, wherein at least one of the metal-based nitride, metal-based carbide and metal-based oxide is a material selected from the group consisting of: tungsten carbide carbon, titanium aluminum nitride, titanium carbo-nitride, chromium nitride, chromium carbide, and chromium oxide.

9. The gear pump of claim 7, wherein the internal moving parts are coated with between about 2 microns and about 5 microns of the coating material.

10. The gear pump of claim 7, wherein the metallic internal moving parts have a Rockwell C hardness of at least about 56.

11. The gear pump of claim 7, wherein the coating material has a Rockwell C hardness of at least about 56.

12. A gear pump for dispensing resin, the pump comprised of metallic internal, relatively moving parts including shafts, bearings, plates and gears having metallic interacting surfaces, wherein each of said metallic interacting surfaces are coated with at least one coating material selected from the group consisting of: a metal-based nitride, a metal-based carbide, and a metal-based oxide, wherein the two internal, relatively moving parts include a shaft received by a bearing and wherein the shaft is coated with a layer of titanium aluminum nitride and a second layer of tungsten carbide carbon and the bearing is coated with titanium aluminum nitride.

* * * * *